US007144338B2

(12) United States Patent
Sullivan et al.

(10) Patent No.: US 7,144,338 B2
(45) **Date of Patent: *Dec. 5, 2006**

(54) GOLF BALL WITH VARYING LAND SURFACES

(75) Inventors: Michael J. Sullivan, Barrington, RI (US); Edmund A. Hebert, Fairhaven, MA (US); Nicholas M. Nardacci, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/980,203

(22) Filed: Nov. 3, 2004

(65) Prior Publication Data

US 2005/0064958 A1 Mar. 24, 2005

Related U.S. Application Data

(63) Continuation-in-part of application No. 10/779,153, filed on Feb. 13, 2004, now Pat. No. 6,884,183, which is a continuation of application No. 10/157,364, filed on May 29, 2002, now Pat. No. 6,695,720.

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS

| | | | | |
|---|---|---|---|---|
| 4,090,716 | A | 5/1978 | Martin et al. | 273/232 |
| 4,830,378 | A * | 5/1989 | Aoyama | 473/384 |
| 4,960,282 | A | 10/1990 | Shaw | 273/232 |
| 5,174,578 | A * | 12/1992 | Oka et al. | 473/384 |
| 5,338,039 | A | 8/1994 | Oka et al. | 273/232 |
| 5,377,989 | A | 1/1995 | Machin | 273/232 |
| 5,547,197 | A | 8/1996 | Pocklington | 473/384 |
| 5,682,230 | A | 10/1997 | Anfinsen et al. | 356/28 |
| 5,692,974 | A | 12/1997 | Wu et al. | 473/377 |
| 5,783,293 | A | 7/1998 | Lammi | 428/212 |
| 5,879,245 | A | 3/1999 | Hwang | 473/384 |
| 5,885,172 | A | 3/1999 | Hebert et al. | 473/354 |
| 5,919,100 | A | 7/1999 | Boehm et al. | 473/354 |
| 5,957,786 | A | 9/1999 | Aoyama | 473/379 |
| 6,152,834 | A | 11/2000 | Sullivan | 473/365 |
| 6,186,002 | B1 | 2/2001 | Lieberman et al. | 73/32.1 |
| 6,285,445 | B1 | 9/2001 | Winfield et al. | 356/28 |
| 6,290,615 | B1 | 9/2001 | Ogg | 473/378 |
| 6,358,161 | B1 | 3/2002 | Aoyama | 473/383 |
| 6,695,720 | B1 | 2/2004 | Sullivan | 473/378 |
| 6,729,976 | B1 | 5/2004 | Bissonnette et al. | 473/383 |

(Continued)

FOREIGN PATENT DOCUMENTS

| | | |
|---|---|---|
| WO | WO 00/23519 | 4/2000 |

(Continued)

*Primary Examiner*—Raeann Gorden

(57) ABSTRACT

A golf ball comprising a substantially spherical outer surface and a plurality of dimples formed thereon is provided. The dimples include polygonal dimples that are arranged such that the sides of adjacent polygonal dimples are substantially parallel to each other, and wherein the land area comprises first spacings and second spacings between adjacent dimples. The first spacings and the second spacings have substantially constant width between any two adjacent dimples and the width of the first spacings is different from the width of the second spacings. Circular dimples and circular land areas may also be included in the dimple pattern. The dimple pattern is easily adjusted to manipulate the aerodynamic efficiency of the golf ball.

8 Claims, 5 Drawing Sheets

U.S. PATENT DOCUMENTS

| | | | | |
|---|---|---|---|---|
| 6,796,912 | B1 | 9/2004 | Dalton et al. | 473/383 |
| 6,884,183 | B1 * | 4/2005 | Sullivan | 473/383 |
| 2003/0045378 | A1 * | 3/2003 | Bissonnette et al. | 473/378 |

FOREIGN PATENT DOCUMENTS

| | | |
|---|---|---|
| WO | WO 00/29129 | 5/2000 |

* cited by examiner

GOLF BALL WITH VARYING LAND SURFACES

STATEMENT OF RELATED APPLICATION

This application is a continuation-in-part of U.S. application Ser. No. 10/779,153 filed on Feb. 13, 2004, now U.S. Pat. No. 6,884,183 which is a continuation of U.S. application Ser. No. 10/157,364 filed on May 29, 2002, now U.S. Pat. No. 6,695,720, issued on Feb. 24, 2004. The entire disclosures of the related applications are incorporated by reference herein

FIELD OF THE INVENTION

The present invention relates to golf balls, and more particularly, to a golf ball having improved dimple patterns.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities, thus different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the boundary layer stays attached further along the ball's outer surface. As a result, there is a reduction in the area of the wake, an increase in the pressure behind the ball, and a substantial reduction in drag. It is the circumference of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference of each dimple is important in optimizing this flow phenomenon, as well.

By using dimples to decrease drag and increase lift, almost every golf ball manufacturer has increased their golf ball flight distances. In order to improve ball performance, it is desirable to have a large number of dimples, hence a large amount of dimple circumference, which is evenly distributed around the ball. In arranging the dimples, an attempt is made to minimize the space between dimples, because such space does not improve aerodynamic performance of the ball. In practical terms, this usually translates into 300 to 500 circular dimples with a conventional sized dimple having a diameter that typically ranges from about 0.120 inches to about 0.180 inches.

When compared to one conventional size dimple, theoretically, an increased number of small dimples will create greater aerodynamic performance by increasing total dimple circumference. However, in reality small dimples are not always very effective in decreasing drag and increasing lift. This results at least in part from the susceptibility of small dimples to paint flooding. Paint flooding occurs when the paint coat on the golf ball fills the small dimples, and consequently decreases the dimple's aerodynamic effectiveness. On the other hand, a smaller number of large dimples also begin to lose effectiveness. This results from the circumference of one large dimple being less than that of a group of smaller dimples.

Another attempt to improve dimple coverage is to use polygonal dimples with the polyhedron dimple surfaces, i.e., dimple surfaces constructed from one or more planar surfaces, as suggested in a number of patent references including U.S. Pat. Nos. 6,290,615, 5,338,039, 5,174,578, 4,830,378, and 4,090,716 among others. Theoretically, higher dimple coverage is attainable with these polygonal dimples. As shown in FIGS. 1 and 2, the land area between the polygonal dimples typically has uniform width throughout the surface of the ball. As the width of the land area decreases, the dimple coverage increases.

As a result, there remains a need in the art to fine tune the distance that a golf ball would travel when impacted without affecting the other desired qualities of the golf ball.

SUMMARY OF THE INVENTION

The present invention is directed to a golf ball having a substantially spherical land surface with a plurality of dimples disposed thereupon. The dimples include polygonal portions and are arranged on the spherical surface such that the sides of neighboring polygonal portions are substantially parallel to one another. The dimple pattern defines a first width between a first dimple and a neighboring second dimple and a second width between the first dimple and a neighboring third dimple. The widths are constant between any two given dimples, but the first width and the second width are different.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
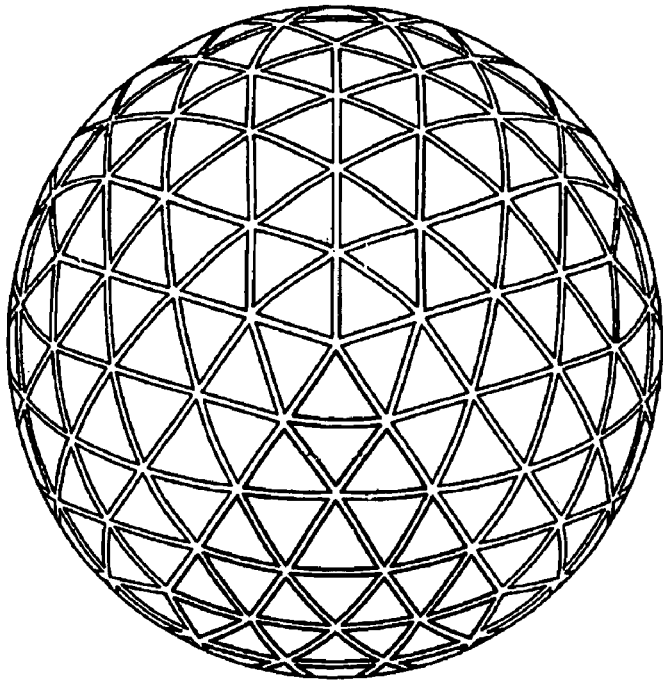
FIG. 1 (PRIOR ART)
FIG. 1 is a plan view of a conventional golf ball with triangular dimples.
Figure 2:
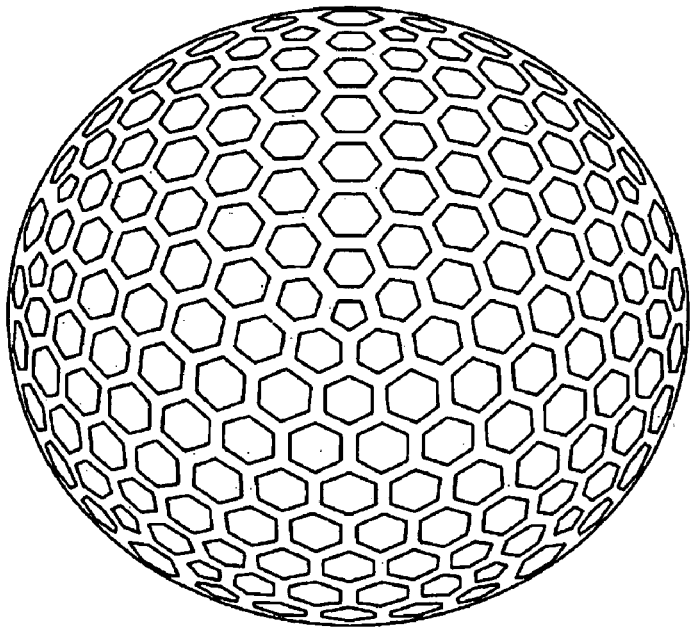
FIG. 2 (PRIOR ART)
FIG. 2 is a plan view of another conventional golf ball with hexagon and pentagon dimples.

With polygonal dimples, the land or un-dimpled surfaces can approach zero when the land surfaces separating the polygonal dimples approach thin lines. With nearly zero land surfaces and highly resilient core/cover materials the golf ball may exceed currently available distance and overall performance levels.

The distance that a golf ball would travel upon impact is a function of the coefficient of restitution (CoR) and the aerodynamic characteristics of the ball. The CoR is defined as the ratio of the relative velocity of two colliding objects after the collision to the relative velocity of the two colliding objects prior to the collision. The CoR varies from 0 to 1.0. A CoR value of 1.0 is equivalent to a perfectly elastic collision, and a CoR value of 0.0 is equivalent to a perfectly inelastic collision. For golf balls, CoR has been approximated as a ratio of the velocity of the golf ball after impact to the velocity of the golf ball prior to impact.

COR is an important measurement of the collision between the ball and a large mass. One conventional technique for measuring COR uses a golf ball or golf ball subassembly, air cannon, and a stationary vertical steel plate. The steel plate provides an impact surface weighing about 100 pounds or about 45 kilograms. A pair of ballistic light screens, which measure ball velocity, are spaced apart and located between the air cannon and the steel plate. The ball is fired from the air cannon toward the steel plate over a range of test velocities from 50 ft/sec to 180 ft/sec. Unless noted otherwise, all COR data presented in this application are measured using a speed of 125 ft/sec. As the ball travels toward the steel plate, it activates each light screen so that the time at each light screen is measured. This provides an incoming time period proportional to the ball's incoming velocity. The ball impacts the steel plate and rebounds though the light screens, which again measure the time period required to transit between the light screens. This provides an outgoing transit time period proportional to the ball's outgoing velocity. The COR can be calculated by the ratio of the outgoing transit time period to the incoming transit time period.

The CoR of the golf ball is affected by a number of factors including the composition the core and the composition of the cover. The core may be single layer core or multi-layer core. It may also be solid or fluid filled. It may also be wound or foamed, or it may contain fillers. On the other hand, the cover may also be single layer cover or multi-layer cover. The cover may be thin or thick. The cover may have a high hardness or low hardness to control the spin and feel of the ball. The cover may comprise a thermoplastic or a thermoset material, or both. Compositions and dimensions of the cover and the core have been fully discussed in the art, including but not limited to U.S. Pat. Nos. 6,419,535, 6,152,834, 5,919,100, 5,885,172, 5,783,293, 5,692,974, and PCT Publication Nos. WO 00/29129 and WO 00/23519, all of which are hereby incorporated by reference in their entireties. Any of the above factors can contribute to the CoR of the ball.

The golf ball preferably comprises a core and a cover. The core may have one or more layers, and the cover may also have one or more layers. The inner cover layer or the outer cover layer may comprise a polyurethane, a polyurea, a polyurethane ionomer, a partially or fully neutralized ionomer, a metallocene catalyzed polymer, or blends thereof. Preferably, the outer cover layer has a thickness of about 0.015 inch to about 0.060 inch, and the inner cover layer has a thickness of about 0.015 inch to about 0.060 inch. Also, the outer cover layer preferably has a Shore D hardness of about 10 to about 70, and the inner cover layer has a Shore D hardness of about 40 to about 90. Also preferably the PGA compression of the ball is in the range of about 30 to about 100.

Hardness is preferably measured pursuant to ASTM D-2240 in either button or slab form on the Shore D scale. More specifically, Shore D scale measures the indentation hardness of a polymer. The higher Shore D value indicates higher hardness of the polymer.

Compression is measured by applying a spring-loaded force to the golf ball center, golf ball core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

(Atti or PGA compression)=(160-Riehle Compression).

Figure 3:
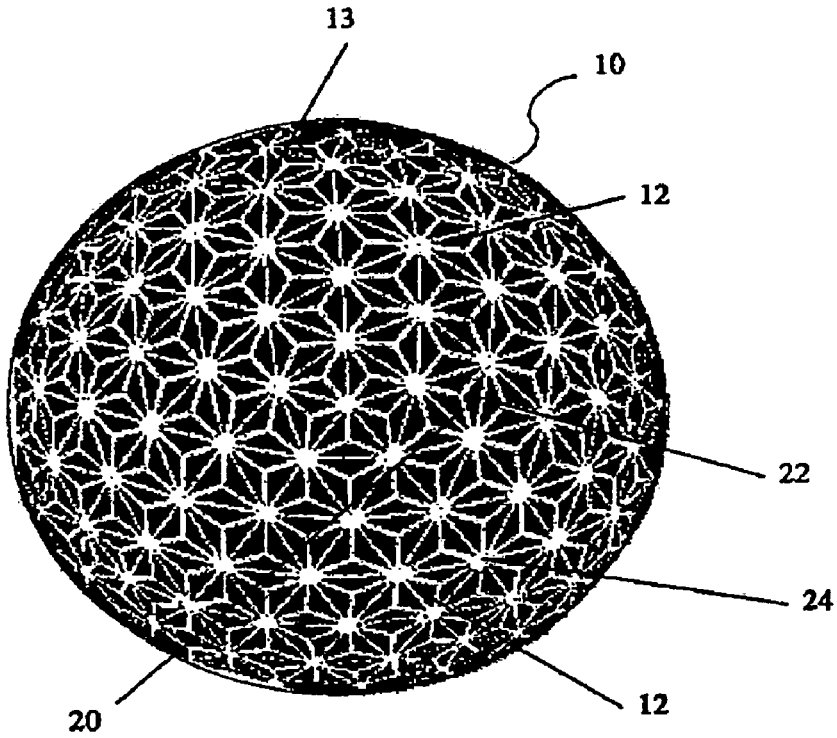
FIG. 3 is a plan view of a golf ball with a dimple pattern according to an embodiment of the present invention.
Figure 3A:
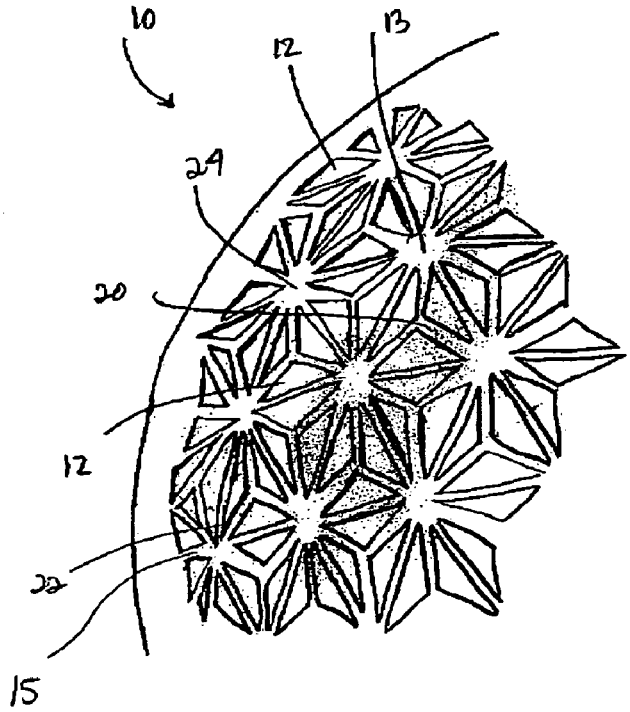
FIG. 3A is an enlargement of a section of FIG. 3.

In accordance with one aspect of the present invention, a modified dimple pattern is provided to adjust incrementally the distance that the ball would travel without affecting the other qualities of the ball. As shown generally in FIG. 3, where like numbers designate like parts, reference number 10 broadly designates a golf ball 10 having a spherical surface. The spherical surface is defined by points lying on a 1.68 inch diameter of golf ball 10 for USGA regulation golf balls. For non-regulation golf balls, the spherical surface may instead be considered an inner-sphere which is covered by an outer surface, such as is described in the '615 patent, previously incorporated herein by reference. In the '615 patent the spherical surface is covered by a raised tubular lattice. Either concept for the spherical surface applies to the present invention. As shown in FIG. 3A, the spherical surface may be covered by a tubular lattice 15.

A plurality of dimples 12 separated by outer un-dimpled or land surfaces, designated generally as 13, is provided on an outer surface of golf ball 10. As shown, dimples 12 are triangular. Suitable dimples for use with this invention include dimples of any shape, including triangular, square, rectangular, pentagon, hexagon, heptagon, octagon, any other polygons, circular, hemispherical, elliptical, or any other shape. Preferably, polygonal dimples 12 are chosen, and the resultant dimple pattern may or may not include circular dimples. The present invention is not limited to any particular dimple shapes illustrated herein.

Preferably, dimples 12 are depressions extending into the cover of golf ball 10. Alternatively, dimples 12 may be raised projections extending beyond the spherical surface of golf ball 10.

The dimple pattern is preferably arranged into identifiable sections or regions that form an overall pattern on the surface of golf ball 10. Preferably, dimples 12 are generally arranged in an icosahedron pattern, i.e., comprising twenty (20) identifiable triangular sections. Other suitable patterns include tetrahedron, octahedron, hexahedron and dodecahedron, among other polyhedrons, or any other discernable grouping of dimples.

As used herein, "inter-dimple spacing" is the width of land area 13 between any two adjacent dimples 12. Preferably, the inter-dimple spacings between any two adjacent polygonal dimples are substantially constant. In other words, the sides of adjacent polygonal dimples are substantially parallel to each other forming constant spacing between them, such as spacings 20 and 22 as shown in FIG. 3. An inter-dimple spacing may also have a circular or other non-polygonal configuration, such as spacing 24. The aggregate of all inter-dimple spacings forms land area 13. Preferably, the surface area of land area 13 is not more than about 40% of the total surface area of the spherical surface of golf ball 10. More preferably, less than about 30% of the total surface area of golf ball 10 is land area. Even more preferably, less than about 20% of the total surface area of golf ball 10 is land area.

As shown in the embodiment of FIG. 3, dimples 12 are triangular depressions separated by either a relatively thin inter-dimple spacing 22 or a relatively thick inter-dimple spacing 20. Preferably, the widths of inter-dimple spacings 20, 22 range from 0.001 to 0.030 inches. More preferably, the widths of inter-dimple spacings 20, 22 range from 0.003 to 0.025 inches. Even more preferably, the widths of inter-dimple spacings 20, 22 range from 0.005 to 0.012 inches. In accordance with one aspect of the invention, inter-dimple spacings 20, 22 may vary in width throughout ball 10. Further, spacings 20, 22 may either intersect or occasionally meet at a circular inter-dimple spacing 24. In the dimple pattern shown, a thick spacing 20 intersects only with other thick spacings 20 or with a circular spacing 24. Similarly, a thin spacing 22 intersects only with another thin spacing 22 or with a circular spacing 24. Additionally, each dimple 12 is spaced from a first neighboring dimple by thick spacing 20 and from a second neighboring dimple by thin spacing 22. In other words, a first leg of each triangular dimple 12 is bordered by a thick spacing 20 and a second leg is bordered by a thin spacing 22. The third leg of triangular dimple 12 may be adjacent to either a thick spacing 20 or a thin spacing 22. This pattern is repeated over the entire surface of golf ball 10 and results in having a varying land area 13 over the surface of golf ball 10. It will be appreciated by those skilled in the relevant art that this dimple pattern is one of many possible dimple patterns that can achieve this varying land area result.

In the embodiment shown in FIG. 3, relatively thick spacings 20 and relatively thin spacings 22 are constant over the entire surface of golf ball 10. In other words, in this embodiment, a particular dimple 12 is separated from its neighboring dimple 12 by one of two widths. Alternatively, the inter-dimple spacings in a single identifiable section may vary. For example, in other embodiments, more than two widths may be used to form the inter-dimple spacings of the pattern of dimples 12. A single section may have any number of different inter-dimple spacings within it. Regardless of the actual width of a particular inter-dimple spacing, preferably the width is constant between polygonal dimples, i.e., the sides of adjacent or neighboring polygonal dimples are substantially parallel to one another.

Further, in the embodiment shown in FIG. 3, all circular spacings 24 have the same diameter over the entire surface of golf ball 10. However, in other embodiments, the diameters may vary. For example, each circular spacing 24 may have a different diameter, or the diameter of any particular circular spacing 24 may be chosen from a set of different appropriate diameters (e.g., two, three, four, etc.).

In addition to polygonal and circular dimples, the inter-dimple spacings of the present invention can also be applied to other types of dimples, such as polygonal dimples on spherical surfaces as described in commonly owned, co-pending application, Ser. No. 10/077,090 filed on Feb. 15, 2002, entitled "Golf Ball With Spherical Polygonal Dimples", the disclosure of which is incorporated herein in its entirety by reference thereto. Other types of suitable dimples include polygonal dimples separated by a tubular lattice as described in the '615 patent, the isodiametrical dimples as described in U.S. Pat. No. 5,377,989, or the dimples as described in U.S. Pat. No. 4,960,282. The disclosures of each of these references are incorporated herein by reference. A tubular lattice comprises a plurality of connecting tubular projections disposed on the surface of the ball, wherein the cross-sectional profile of each projection has its apex located farthest from the center of the ball. An isodiametrical dimple comprises an odd number of sides and arcuate apices, wherein the sides have equal curvature. An overlapping dimple has a perimeter formed by placing two dimples, preferably circular dimples, in an overlapping manner.

The varying inter-dimple spacings allow fine tuning of a highly efficient aerodynamic dimple pattern to adjust the distance that a ball would travel without switching to other dimple patterns. Fine-tuning an efficient dimple pattern provides more certainty of achieving the desired result than experimenting with a completely different dimple pattern, or by changing the composition of the core and/or the cover to alter the CoR. For example, as discussed above, one advantage of enlarging at least some of the inter-dimple spacings is to decrease selectively the dimple coverage, such that the distance that a high-performance golf ball would travel upon impact would adhere to the USGA distance limit.

Figure 4:
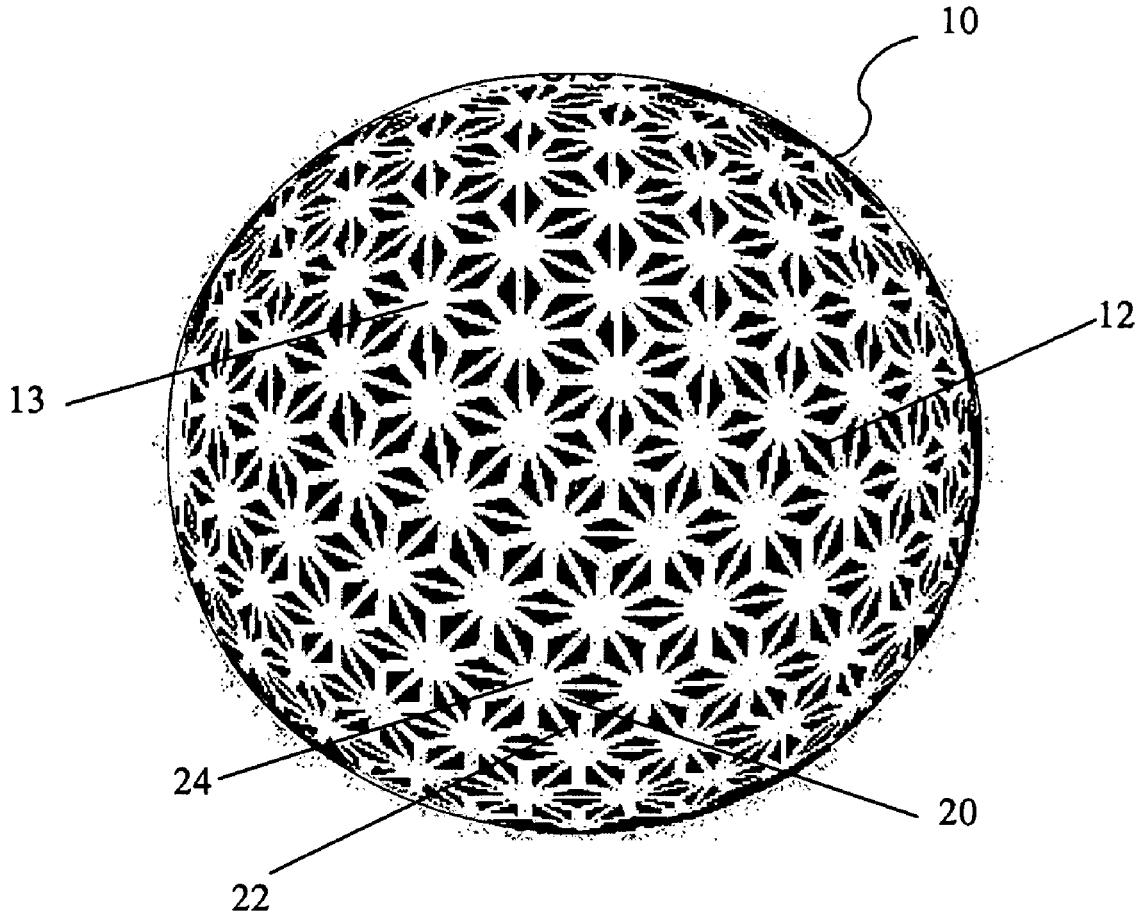
FIG. 4 is a plan view of a golf ball with a dimple pattern according to a second embodiment of the present invention.

Another embodiment of the present invention is shown in FIG. 4 to exemplify this aspect of the invention. This embodiment is similar to the embodiment shown in FIG. 3 in that a golf ball 10 includes a pattern of dimples 12 on its outer surface. The pattern of dimples 12 of golf ball 10 is the same general pattern as that shown in FIG. 3. Dimples 12 are preferably triangular, and the inter-dimple spacings are relatively thick inter-dimple spacings 20, relatively thin inter-dimple spacings 22, and circular inter-dimple spacings 24. However, in this embodiment, inter-dimple spacings 20, 22, 24 are wider or larger in diameter than the corresponding inter-dimple spacings of the embodiment shown in FIG. 3. Consequently, a land area 13, the aggregate surface area of all inter-dimple spacings 20, 22, 24, of golf ball 10 as shown in FIG. 4 is significantly larger than that of the golf ball shown in FIG. 3. As discussed above, the higher the percentage of total surface area devoted to land area 13, the less aerodynamically efficient the golf ball. By merely changing the size of inter-dimple spacings 20, 22, 24 but maintaining the overall dimple pattern, a golf ball may be redesigned relatively easily.

Alternatively, the widths of inter-dimple spacings may be decreased to increase aerodynamic efficiency if a particular combination of materials is traveling too short a distance, i.e., shifting from the dimple pattern shown in FIG. 4 to the dimple pattern shown in FIG. 3. In a preferred embodiment, the spacings 20 and 22 have a width that are equal and are approximately 0.0001 to 0.01 inch wide and, preferably, 0.0005 to 0.001 inch. These spacings not only intersect the circular inter-dimple spacing 24, but preferably bisect the circular inter-dimple spacings. Adjacent spacings 20 and 22 also preferably form acute angles with each other. Tests have shown that distance generally increases with increasing dimple coverage, when all other aspects of the ball and tests are equal. Therefore, producing dimple designs having as high coverage as possible is very desirable for many types of golf balls. As discussed above, preferably the combined land area is less than 40% of the total surface area of the spherical surface of golf ball 10. Also, the circular land 24 areas can be substituted with circular dimple and forming an embodiment with both non-circular dimples and circular dimples. Thus, the linear land elements 20 and 22 intersect or bisect the circular dimples in this embodiment.

Figure 5:
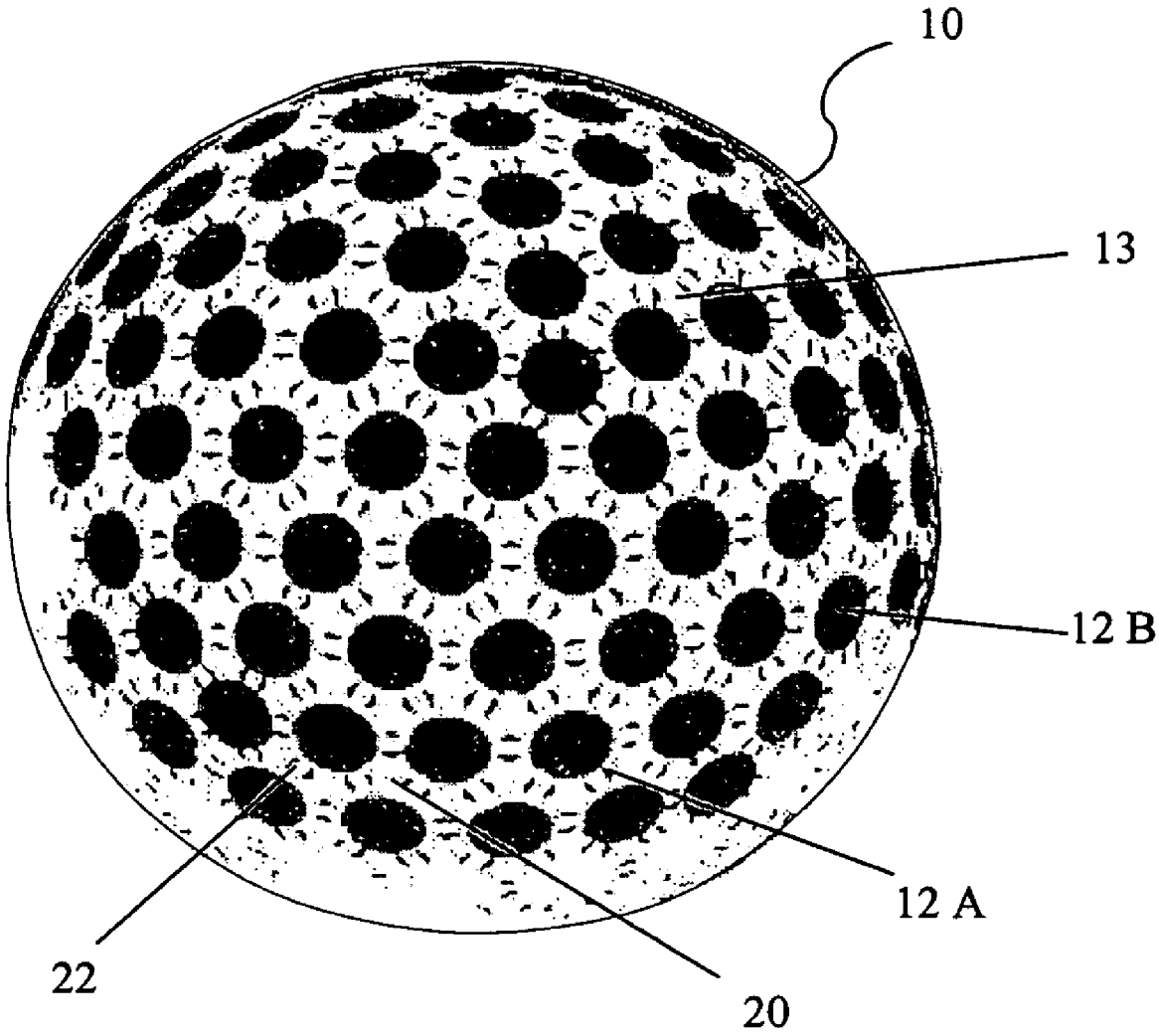
FIG. 5 is a plan view of a golf ball with a dimple pattern according to a third embodiment of the present invention.

Yet another embodiment of the present invention is shown in FIG. 5. In this embodiment, dimples 12 include both non-circular depressions 12A and circular depressions 12B. The sides of non-circular depressions 12A, here triangular polygons, are substantially parallel to one another, resulting in the definition of various inter-dimple spacings, a relatively thick inter-dimple spacing 20 and a relatively thin inter-dimple spacing 22. Circular depressions 12B create slightly rounded ends on inter-dimple spacings 20, 22 where spacings 20, 22 meet circular depressions 12B. This pattern is repeated over the surface of golf ball 10. It will be recognized by those in the relevant art that the percentage of the total surface area dedicated to land area 13 may be just as readily manipulated as in the embodiments shown in FIGS. 3 and 4 simply by altering the width of the inter-dimple spacings 20, 22. Furthermore, it will also be recognized by those in the relevant art that circular inter-dimple spacings 24 in FIGS. 3 and 4 may alternatively be circular depressions similar to circular depressions 12B as shown in FIG. 5.

The inter-dimple spacings of the present invention also impart distinctive outer markings on the ball. One advantage of having distinctive markings is that such markings may assist the golfer's putting game by allowing the golfer to align the ball to the hole and/or to the putter. Also, individual designs for high performance balls may be produced with distinctive markings created by the varying inter-dimple spacings such that these balls would be easily distinguished from other manufacturers' balls. Also, during play, a ball is readily identifiable as belonging to a particular golfer. Further, due to the distinctive patterns, balls may be produced that have an inconspicuous seam or parting line for enhanced marketability.

The present invention is further described herein in terms of aerodynamic criteria that are defined by the magnitude and direction of the aerodynamic forces, for the range of Spin Ratios and Reynolds Numbers that encompass the flight regime for typical golf ball trajectories. These aerodynamic criteria and forces are described below.

Figure 6:
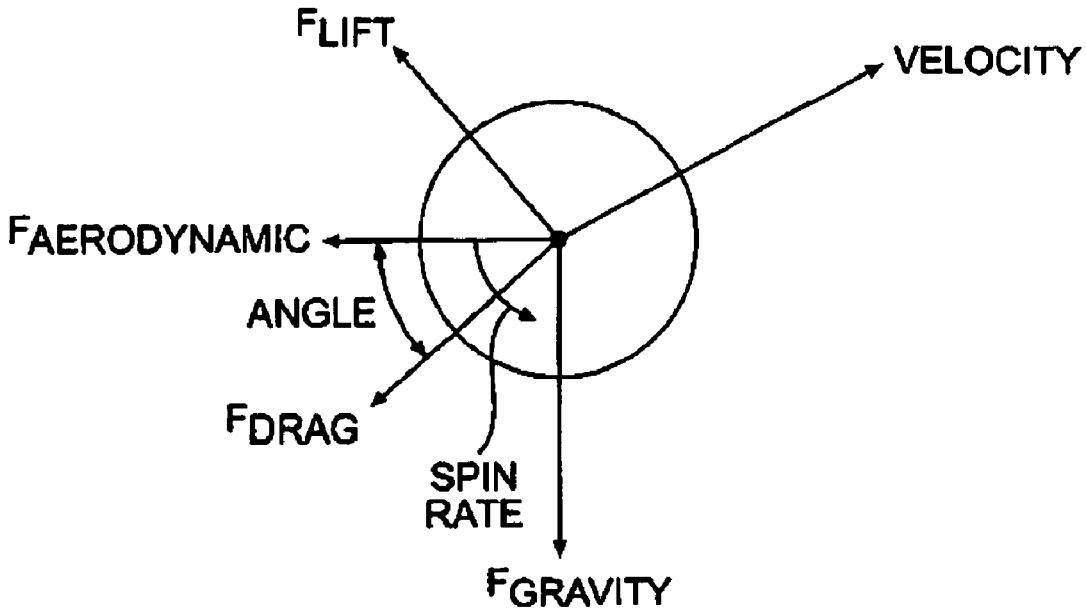
FIG. 6 is an illustration of the forces acting on a golf ball.

The forces acting on a golf ball in flight are enumerated in Equation 1 and illustrated in FIG. 6:

$$F=F_L+F_D+F_G \quad \text{(Eq. 1)}$$

Where F=total force vector acting on the ball $F_L$=lift force vector $F_D$=drag force vector $F_G$=gravity force vector The lift force vector ($F_L$) acts in a direction dictated by the cross product of the spin vector and the velocity vector. The drag force vector ($F_D$) acts in a direction that is directly opposite the velocity vector. The magnitudes of the lift and drag forces of Equation 1 are calculated in Equations 2 and 3, respectively:

$$F_L=0.5C_L\rho AV^2 \quad \text{(Eq. 2)}$$

$$F_D=0.5C_D\rho AV^2 \quad \text{(Eq. 3)}$$

where ρ=density of air (slugs/ft$^3$)

A=projected area of the ball (ft$^2$) ((π/4)D$^2$)

D=ball diameter (ft)

V=ball speed (ft/s)

$C_L$=dimensionless lift coefficient $C_D$=dimensionless drag coefficient

Lift and drag coefficients are typically used to quantify the force imparted to a ball in flight and are dependent on air density, air viscosity, ball speed, and spin rate. The influence of all these parameters may be captured by two dimensionless parameters: Spin Ratio (SR) and Reynolds Number ($N_{Re}$). Spin Ratio is the rotational surface speed of the ball divided by ball speed. Reynolds Number quantifies the ratio of inertial to viscous forces acting on the golf ball moving through air. SR and $N_{Re}$ are calculated in Equations 4 and 5 below:

$$SR=\omega(D/2)/V \quad \text{(Eq. 4)}$$

$$N_{Re}=DV\rho/\mu \quad \text{(Eq. 5)}$$

where ω=ball rotation rate (radians/s) (2π(RPS))

RPS=ball rotation rate (revolution/s)

V=ball speed (ft/s)

D=ball diameter (ft)

ρ=air density (slugs/ft$^3$)

μ=absolute viscosity of air (lb/ft-s)

There are a number of suitable methods for determining the lift and drag coefficients for a given range of SR and $N_{Re}$, which include the use of indoor test ranges with ballistic screen technology. U.S. Pat. No 5,682,230, the entire disclosure of which is incorporated by reference herein, teaches the use of a series of ballistic screens to acquire lift and drag coefficients. U.S. Pat. Nos. 6,186,002 and 6,285,445, also incorporated in their entirety by reference herein, disclose methods for determining lift and drag coefficients for a given range of velocities and spin rates using an indoor test range, wherein the values for $C_L$ and $C_D$ are related to SR and $N_{Re}$ for each shot. One skilled in the art of golf ball aerodynamics testing could readily determine the lift and drag coefficients through the use of an indoor test range, or alternatively in a wind tunnel.

The aerodynamic property of a golf ball can be quantified by two parameters that account for both lift and drag simultaneously: (1) the magnitude of aerodynamic force ($C_{mag}$), and (2) the direction of the aerodynamic force (Angle). It has now been discovered that flight performance improvements are attained when the dimple pattern and dimple profiles are selected to satisfy preferred magnitude and direction criteria. The magnitude and angle of the aerodynamic force are related to the lift and drag coefficients and, therefore, the magnitude and angle of the aerodynamic coefficients are used to establish the preferred criteria. The magnitude and the angle of the aerodynamic coefficients are defined in Equations 6 and 7 below:

$$C_{mag}=\sqrt{(C_L^2+C_D^2)} \quad \text{(Eq. 6)}$$

$$\text{Angle}=\tan^{-1}(C_L/C_D) \quad \text{(Eq. 7)}$$

To ensure consistent flight performance regardless of ball orientation, the percent deviation of $C_{mag}$ for each SR and $N_{Re}$ plays an important role. The percent deviation of $C_{mag}$ may be calculated in accordance with Equation 8, wherein the ratio of the absolute value of the difference between the $C_{mag}$ for any two orientations to the average of the $C_{mag}$ for these two orientations is multiplied by 100.

$$\text{Percent deviation } C_{mag}=|(C_{mag1}-C_{mag2})|/((C_{mag1}+C_{mag2})/2)*100 \quad \text{(Eq. 8)}$$

where $C_{mag1}=C_{mag}$ for orientation 1, and $C_{mag2}=C_{mag}$ for orientation 2.

To achieve the consistent flight performance, the percent deviation is preferably about 6 percent or less. More preferably, the deviation of $C_{mag}$ is about 3 percent or less.

Aerodynamic asymmetry typically arises from parting lines inherent in the dimple arrangement or from parting lines associated with the manufacturing process. The percent $C_{mag}$ deviation is preferably obtained using $C_{mag}$ values measured with the axis of rotation normal to the parting line plane, commonly referred to as a poles horizontal, "PH" orientation and $C_{mag}$ values measured in an orientation orthogonal to PH, commonly referred to as a pole over pole, "PP" orientation. The maximum aerodynamic asymmetry is generally measured between the PP and PH orientation.

The percent deviation of $C_{mag}$ as outlined above applies to the orientations, PH and PP, as well as any other two orientations. For example, if a particular dimple pattern is used having a great circle of shallow dimples, different orientations should be measured. The axis of rotation to be used for measurement of symmetry in the above example scenario would be normal to the plane described by the great circle and coincident to the plane of the great circle.

It has also been discovered that the $C_{mag}$ and Angle criteria for golf balls with a nominal diameter of 1.68 and a nominal weight of 1.62 ounces may be advantageously scaled to obtain the similar optimized criteria for golf balls of any size and weight. Any preferred aerodynamic criteria may be adjusted to obtain the $C_{mag}$ and angle for golf balls of any size and weight in accordance with Equations 9 and 10.

$$C_{mag(ball)}=C_{mag(nominal)}\sqrt{((\sin(\text{Angle}_{(nominal)})*(W_{ball}/1.62)*(1.68/D_{ball})^2)^2+(\cos(\text{Angle}_{(nominal)})^2)} \quad \text{(Eq. 9)}$$

$$\text{Angle}_{(ball)}=\tan^{-1}(\tan(\text{Angle}_{(nominal)})*(W_{ball}/1.62)*(1.68/D_{ball})^2) \quad \text{(Eq. 10)}$$

It is believed that a golf ball made in accordance with the present invention will share similar characteristics with the golf balls discussed in U.S. Pat. No. 6,729,976, the disclosure of which is incorporated herein in its entirety by reference thereto. Table 1 illustrates the anticipated aerodynamic criteria for a golf ball of the present invention that results in increased flight distances. The criteria are specified as low, median, and high $C_{mag}$ and Angle for eight specific combinations of SR and $N_{Re}$. Golf balls with $C_{mag}$ and Angle values between the low and the high number are preferred. More preferably, the golf balls of the invention have $C_{mag}$ and Angle values between the low and the median numbers delineated in Table 1. The $C_{mag}$ values delineated in Table 1 are intended for golf balls that conform to USGA size and weight regulations. The size and weight of the golf balls used with the aerodynamic criteria of Table 1 are 1.68 inches and 1.62 ounces, respectively.

TABLE 1

Aerodynamic Characteristics For Ball Diameter = 1.68", Ball Weight = 1.62 ozs.

| | | Magnitude | | | Angle | | |
|---|---|---|---|---|---|---|---|
| $N_{Re}$ | SR | Low | Median | High | Low | Median | High |
| 230000 | 0.085 | 0.24 | 0.265 | 0.27 | 31 | 33 | 35 |
| 207000 | 0.095 | 0.25 | 0.271 | 0.28 | 34 | 36 | 38 |
| 184000 | 0.106 | 0.26 | 0.280 | 0.29 | 35 | 38 | 39 |
| 161000 | 0.122 | 0.27 | 0.291 | 0.30 | 37 | 40 | 42 |
| 138000 | 0.142 | 0.29 | 0.311 | 0.32 | 38 | 41 | 43 |
| 115000 | 0.170 | 0.32 | 0.344 | 0.35 | 40 | 42 | 44 |
| 92000 | 0.213 | 0.36 | 0.390 | 0.40 | 41 | 43 | 45 |
| 69000 | 0.284 | 0.40 | 0.440 | 0.45 | 40 | 42 | 44 |

Other anticipated aerodynamic characteristics of the golf ball are described and discussed in greater detail in the '976 patent.

While various descriptions of the present invention are described above, it is understood that the various features of the embodiments of the present invention shown herein can be used singly or in combination thereof. For example, the dimple depth may be the same for all the dimples. Alternatively, the dimple depth may vary throughout the golf ball. The dimple depth may also be shallow to raise the trajectory of the ball's flight, or deep to lower the ball's trajectory. This invention is also not to be limited to the specifically preferred embodiments depicted therein.

What is claimed is:

1. A golf ball comprising:

an outer land surface;

a plurality of non-circular dimples, wherein the outer land surface separates the non-circular dimples and comprises at least one first substantially constant width and at least one second substantially constant width, wherein said first and second widths intersect a circular land portion or a circular dimple, and wherein the first width is different from the second width.

2. The golf ball according to claim 1, wherein said first and second widths intersect said circular dimple.

3. The golf ball according to claim 1, wherein the first and second widths intersect the circular land portion.

4. The golf ball according to claim 1, wherein the plurality of non-circular dimples include at least one polygonal dimple.

5. The golf ball according to claim 1, wherein an outer land surface area is not greater than about 40% of a golf ball total surface area.

6. The golf ball according to claim 1, wherein an outer land surface area is not greater than about 25% of a golf ball total surface area.

7. A golf ball comprising:

an outer land surface;

a plurality of non-circular dimples, wherein the outer land surface separates the non-circular dimples and comprises constant width elements that intersect a circular land portion or a circular dimple, wherein the constant width elements include at least a first constant width element different from a second constant width element.

8. The golf ball of claim 7, wherein the constant width elements form an acute angle and bisect the circular land portion or circular dimple.

* * * * *